United States Patent [19]

Shibusawa

[11] Patent Number: 4,476,895

[45] Date of Patent: Oct. 16, 1984

[54] SHORT GIRDLE

[75] Inventor: Masaru Shibusawa, Kyoto, Japan

[73] Assignee: Wacoal Corp., Kyoto, Japan

[21] Appl. No.: 462,358

[22] Filed: Jan. 31, 1983

[30] Foreign Application Priority Data

Aug. 17, 1982 [JP] Japan ..... 57-142894

[51] Int. Cl.[3] ..... A41C 1/00

[52] U.S. Cl. ..... 128/546; 2/401

[58] Field of Search ..... 128/546, 547, 519; 2/401

[56] References Cited

U.S. PATENT DOCUMENTS 2,997,044 8/1961 Simons ..... 2/519

3,285,248 11/1966 Williams ..... 2/546

*Primary Examiner*—Doris L. Troutman

*Attorney, Agent, or Firm*—Wegner & Bretschneider

[57] ABSTRACT

A short girdle made of elasticized material including a front body (4) formed with front leg hole portions (3*a* and 3*a*′) on opposite sides of its lower edge, and a rear body (2) formed with rear leg hole portions (3*b* and 3*b*′) on opposite sides of its lower edge. An abdomen keep cloth member (4) is sewed to one of a front side surface and a rear side surface of the front body (4) and extends downwardly from an upper edge (5) of the front body toward a central portion of its lower edge in such a manner that the width thereof is successively reduced, and an extension of the abdomen keep cloth member extending downwardly therefrom and connected to a central portion of the lower edge of the rear body constitutes a crotch cloth member formed with inner leg hole portions (3*c* and 3*c*′) each located on one of opposite sides of the crotch cloth member. The lower edge of the front body and side edges (4*a* and 4*b*) of the abdomen keep cloth member contiguous with side edges of the crotch cloth member cross each other and overlap in such a manner that they are able to move relative to each other.

3 Claims, 10 Drawing Figures

SHORT GIRDLE

BACKGROUND OF THE INVENTION

1. Field of the Invention

This invention relates to girdles, and more particularly it is concerned with a short girdle or a girdle of the type having no leg portions.

2. Description of the Prior Art

Like long girdles having leg portions, short girdles have the function of raising the hips and supporting the waist and they have a molding action, too. In short girdles, it has hitherto been usual practice to obtain stability of the lower edge of the girdle body by causing the hems to clamp against the thighs.

The short girdles of the prior art have suffered the disadvantage that the wearer do not feel uncomfortable when they remain stationary while in a standing position but they feel uncomfortable when they are in a walking or sitting position.

SUMMARY OF THE INVENTION

1. Object of the Invention

This invention has been developed for the purpose of obviating the aforesaid disadvantage of the prior art. Accordingly the invention has as its object the provision of a short girdle which does not cause a wearer to feel uncomfortable when she is in a walking or sitting position while being able to perform the essential function of molding the waist and the hips.

2. Statement of the Invention

According to the invention, there is provided a short girdle formed of elasticized material comprising a front body formed with front leg hole portions located on opposite sides of a lower edge thereof, a rear body formed with rear leg hole portions located on opposite sides of a lower edge thereof, an abdomen keep cloth member sewed to one of front and rear side surfaces of the front body and extending downwardly from an upper edge of the front body toward a central portion of its lower edge in such a manner that the width thereof is successively reduced, and a crotch cloth member consecutively extending downwardly from the abdomen keep cloth member and connected at one end thereof to a central portion of the lower edge of the rear body, the crotch cloth member being formed with inner leg hole portions each located on one of opposite sides thereof, the lower edge of the front body and side edges of the abdomen keep cloth member contiguous with side edges of the crotch cloth member crossing each other and overlapping in such a manner that they are able to move relative to each other.

Additional and other objects, features and advantages of the invention will become apparent from the description set forth hereinafter when considered in conjunction with the accompanying drawings.

DETAILED DESCRIPTION OF THE PREFERRED EMBODIMENTS

Figure 9:
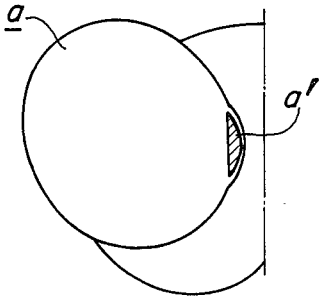
FIG. 9 is a view showing the shape of the thigh when a human body is in a walking position.
Figure 10:
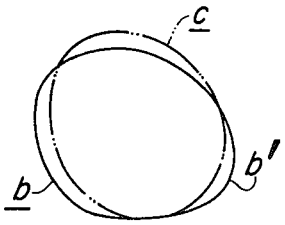
FIG. 10 is a view showing the shape of the thigh of a human body in a sitting position in comparison with the shape thereof of a human body in a standing position.

Referring to FIG. 9, there is shown the shape of the thigh of a human body in a walking position. As can be clearly seen in the figure, when a human body is in a walking position, a muscules gracilis a′ extending longitudinally of a thigh a on an inner side thereof bulges because a force is exerted thereby. FIG. 10 shows a shape b of the thigh of a human body in a sitting position in comparison with a shape c of the thigh when the human body is in a standing position. As can be seen in the figure, the thigh becomes flat and an inner portion b′ of a groin bulges.

Figure 7:
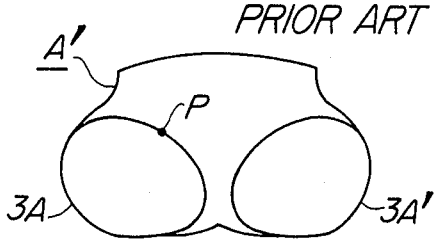
FIG. 7 PRIOR ART
FIGS. 7 and 8 are views in explanation of forces acting on a short girdle of the prior art when the wearer is in a sitting position.
Figure 8:
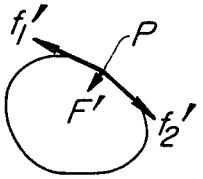
FIG. 8 PRIOR ART

FIG. 7 shows the shape of a short girdle of the prior art when the wearer is in a sitting position. The short girdle comprises a girdle body A′ formed of a single elasticized cloth having left and right leg hole portions 3A and 3A′ each extending peripherally to form a closed loop. When the short girdle of this shape is worn and the wearer is in a sitting position, the thigh of the wearer will be shaped as indicated at b in FIG. 10. When this is the case, a resultant force F′ of forces $f'_1$ and $f'_2$ shown in FIG. 8 will act on a point P of the leg hole portion 3A or on the groin, and the resultant force F′ will act on the thigh in such a manner that an inordinately high force will be exerted on the groin. A similar force will act on a point P′ of the leg hole portion 3A′. This would cause the leg hole portions of the short girdle to bits into the groins, with a result that the wearer would feed pain at the groins. The wearer would feel uncomfortable when she is in a walking position because of the shape of the thigh as shown in FIG. 9.

To obviate the aforesaid problem encountered in the prior art, proposals have been made to shape the front body in the form of a letter V in a portion thereof which is contiguous with the crotch cloth to increase the leg hole portions in size, and to use material of increased elasticity to provide a short girdle. These two proposals have, however, been unable to achieve satisfactory results. In the former, the leg hole portions become loose and make it impossible to perform the function of supporting the waist and the hips; and in the latter, it is impossible to satisfactorily perform the function of molding the waist and hips.

Embodiments of the invention developed for the purpose of obviating the aforesaid disadvantage of the prior art will be described by referring to the accompanying drawings.

Figure 1:
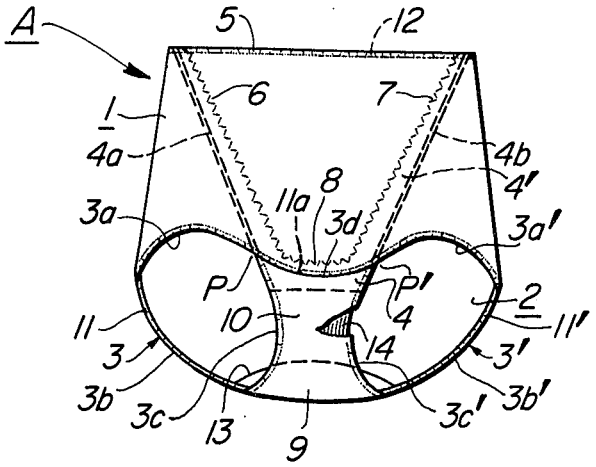
FIGS. 1–5 are front views of the short girdles according to first to fifth embodiments of the invention.

FIG. 1 shows a first embodiment comprising a girdle body A of elasticized material that can be stretched both vertically and horizontally. The girdle body A includes a front body 1, and an abdomen keep backing cloth member 4 located at the back of the front body 1 and extending downwardly from opposite sides of an upper edge 5 of the front body 1 in such a manner that it has its width successively reduced in the form of a letter V. The abdomen keep backing cloth member 4 is formed of the same plasticized material as the girdle body A, so that the front body 1 serving as an upper cloth member and the abdomen keep back cloth member 4 serving as an under cloth member located in overlapping relation can have the elasticity of the material increased. This is conductive to improvements in the waist supporting function performed by the short girdle according to the invention. The abdomen keep backing cloth member 4 is sewed, as indicated at 6 and 7, to the front body 1 in such a manner that they are joined in positions slightly inwardly of opposite side edges 4*a* and 4*b* of the abdomen keep backing cloth member 4 and extending downwardly along the opposite side edges 4*a* and 4*b* from the upper edge 5 of the front body 1 until they are located adjacent a lower edge of the front body 1. In the first embodiment shown and described herein, portions 4' of the abdomen keep backing cloth member 4 located outside the seams 6 and 7 are shaped such that their width successively increases in going downwardly from the upper edge 5 of the front body 1 toward its lower edge to prevent wrinkle formation therein. The numeral 8 designates a seam at which the front body 1 is sewed to the abdomen keep backing cloth member 4 along a central portion of the lower edge of the front body 1 between the seams 6 and 7. The abdomen keep backing cloth member 4 includes a portion 9 extending downwardly from the lower edge of the front body 1 and sewed at its lower end to a rear body 2 at a central portion of its lower edge as indicated at 13 to provide a crotch cloth member 10 at the extension 9.

The short girdle according to the invention is formed with leg holes 3 and 3' including front leg hole portions 3*a* and 3*a'* located on opposite sides of the lower edge of the front body 1, rear leg hole portions 3*b* and 3*b'* located on opposite sides of a lower edge of the rear body 2, and inner leg hole portions 3*c* and 3*c'* located or opposite sides of the crotch cloth member 10. The leg portion 3 including the leg hole portions 3*a*, 3*b* and 3*c* and the leg hole 3' including the leg hole portions 3*a'*, 3*b'* and 3*c'* enclose the right and left thighs respectively of the girdle wearer. The numeral 3*d* designates a central portion of the lower edge of the front body connecting the left and right front leg hole portions 3*a* and 3*a'* together.

Elastic tapers 11 and 11' extend along the opposite side edges 4*a* and 4*b* of the abdomen keep backing cloth member 4 from their upper ends to their lower ends and further along the leg portions 3 and 3' respectively, to be connected together by a tape portion 11*a* extending through a central portion 3*d* of the lower edge of the front body 1. The central portion 3*d* of the lower edge of the front body 1 and the tape portion 11*a* sewed on to this portion are loosely curved in a manner to project downwardly in convex form. The numerals 12 and 14 designate a tape portion located on the back of the abdomen keep backing cloth member 4 along the upper edge 5 of the front body 1 and sewed on to the backing cloth member 4 and the front body 1, and a nonflexible soft cloth member located on the back of the crotch cloth member 10.

Portions of the tapers 11 and 11' extending on the opposite side edges 4*a* and 4*b* of the abdomen keep backing cloth member 4, portions of the tape 11 and 11' extending along the inner leg hole portions 3*c* and 3*c'*, portions of the tapes 11 and 11' extending along the rear leg hole portions 3*b* and 3*b'*, portions of the tapes 11 and 11' extending along the front leg hole portions 3*a* and 3*a'* and the aforesaid tape portion 11*a* are sewed on to the back of the respective cloth members. When the material used for forming the short girdle is of high elasticity, the tapes 11 and 11' may be done without.

The lower edge portion of the front body 1 constitute by the front leg hole portions 3*a* and 3*a'* and the central portion 3*d* and the left side edge 4*a* of the abdomen keep backing cloth member 4 contiguous with the left side edge of the crotch cloth member 10 cross each other at a point P on the boundary between the front body 1 and the crotch cloth member 10 and overlap in superposed relation. Likewise, the lower edge portion of the front body 1 and the right side edge 4*b* of the abdomen keep backing cloth member 4 contiguous with the right side edge of the crotch cloth member 10 cross each other at a point P' on the boundary between the front body 1 and the crotch cloth member 10 and overlap in superposed relation. The aforesaid overlaps are not sewed together at the points P and P'. That is, the front body 1 and the abdomen keep backing cloth member 4 connected to the crotch cloth member 10 are not sewed to each other at the points P and P', to enable the cloth portions overlapping each other at the points P and P' to move slightly relative to each other. When the elastic tapes 11 and 11' are used as is the case with the embodiment shown, the portions of the tapes 11 and 11' overlapping each other at the points P and P' can move relative to each other with respect to the points P and P'. The points P and P' correspond to the groins of the wearer of the short girdle.

Figure 2:
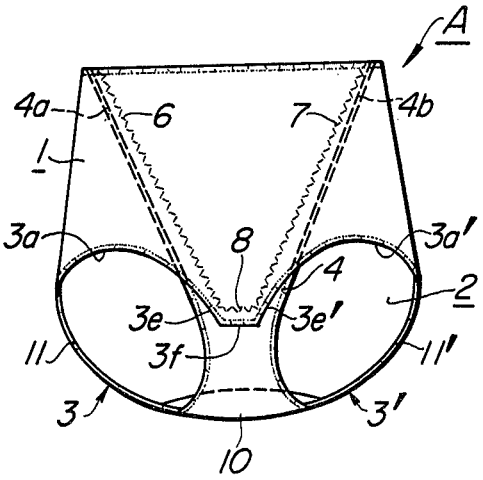
Figure 3:
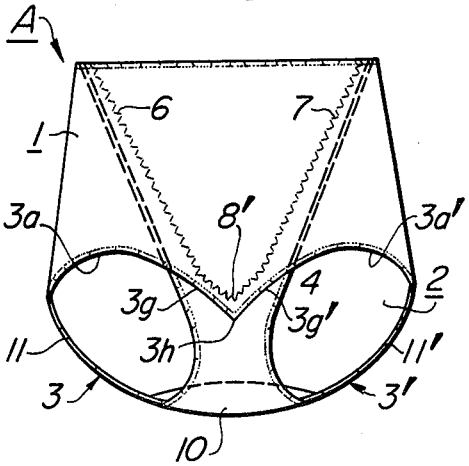

FIGS. 2 and 3 show second and third embodiments in which the shape of the leg holes 3 and 3' of the first embodiment is modified. More specifically, in the second embodiment, the central portion of the lower edge of the front body 1 or a portion corresponding to the portion 3*d* of the first embodiment includes depending portions 3*e* and 3*e'* extending inwardly downwardly from the front leg hole portions 3*a* and 3*a'* respectively, and a horizontal portion 3*f* connecting the depending portions 3*a* and 3*e'* together at their lower ends. The seams 6 and 7 extend slightly further downwardly than in the first embodiment until the seams 6 and 7 are connected together at their lower ends by a horizontal seam 8 in a position above the horizontal portion 3*f*. The elastic tapes 11 and 11' are sewed to the respective cloth members in a manner to extend along the opposite side edges 4*a* and 4*b* of the abdomen keep backing cloth member 4, leg holes 3 and 3', depending portions 3*e* and 3*e'* and horizontal portion 3*f*.

In the third embodiment shown in FIG. 3, the central portion of the lower edge of the front body 1 or a portion corresponding to the portion 3*d* of the first embodiment includes depending portions 3*g* and 3*g'* extending inwardly downwardly from the front leg hole portions 3*a* and 3*a'* respectively. The depending portions 3*g* and 3*g'* extend in the form of a letter V until they are connected together at third lower ends 3*h*, so that the horizontal portion 3*f* of the second embodiment is eliminated in the third embodiment. The seams 6 and 7 extend downwardly until they are connected together in a position 7' located above the lower ends 3*h*. The elastic tapes 11 and 11' are sewed on to the respective cloth members in a manner to extend along the opposite side edges 4*a* and 4*b* of the abdomen keep backing cloth member 4, leg holes 3 and 3' and the depending portions 3*g* and 3*g'* respectively. In the second and third embodiments, the soft cloth member 14 described by referring to the first embodiment is eliminated.

The second and third embodiments are similar to the first embodiment in parts other than the parts described hereinabove, and parts shown in FIGS. 2 and 3 similar to those shown in FIG. 1 are designated by like reference characters.

Figure 4:
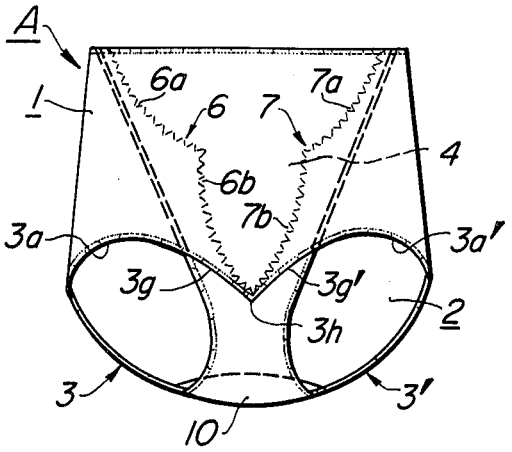

FIG. 4 shows a fourth embodiment in which the front body 1 and the abdomen keep backing cloth member 4 are sewed together at the seams 6 and 7 each comprising two arcuate lines. More specifically, the seam 6 includes a first arcuate line 6*a* extending downwardly rightwardly from a left end position on the upper edge 5 of the front body 1 so as to form a convex curve directed leftwardly, and a second arcuate line 6*b* extending downwardly rightwardly from a lower end of the first arcuate line 6*a* so as to form a convex curve directed leftwardly. Likewise, the other seam 7 includes a first arcuate line 7*a* extending downwardly leftwardly from a right end position on the upper edge 5 of the front body 1 so as to form a convex curve directed rightwardly, and a second arcuate line 7*b* extending downwardly leftwardly from a lower end of the first arcuate line 7*a* so as to form a convex curve directed rightwardly. The central portion of the lower edge of the front body 1 of the fourth embodiment is of the same shape as that of the third embodiment. That is, the depending portions 3*g* and 3*g*′ extend downwardly inwardly from the front leg hole portions 3*a* and 3*a*′ respectively in the form of a letter V until they are connected together at the lower ends 3*h*. Lower ends of the second arcuate line 6*b* of the seam 6 and the second arcuate line 7*b* of the seam 7 are connected together in a position corresponding to the lower ends 3*h* of the depending portions 3*g* and 3*g*′.

Parts of the fourth embodiment other than those described hereinabove are similar to those described by referring to the first to the third embodiments, and parts shown in FIG. 4 similar to those shown in FIGS. 1–3 are designated by like reference characters. The soft cloth member 14 described by referring to the first embodiment is eliminated in the fourth embodiment.

Figure 5:
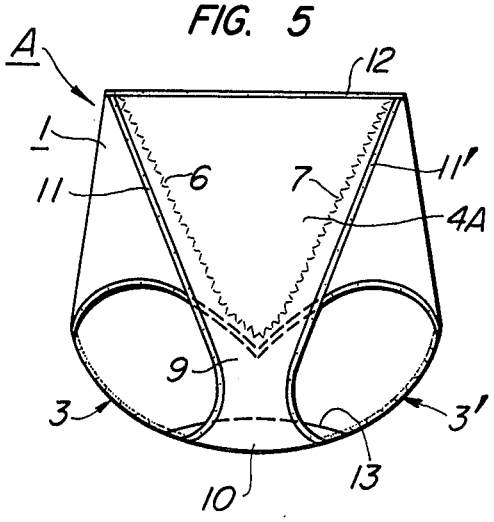

FIG. 5 shows a fifth embodiment which corresponds to the short girdle of the third embodiment turned inside out. More specifically, in the fifth embodiment, the construction of the third embodiment in which the abdomen keep backing cloth member 4 attached to the front body 1 is altered so that the abdomen keep backing cloth member 4 is eliminated and an abdomen keep front cloth member 4A of substantially the same shape as the abdomen keep backing cloth member 4 is attached to the front body 1. The front cloth member 4A overlaps the front body 1 to increase resilience or elasticity of the material. The front cloth member 4A extends further downwardly from the position of the lower edge of the front body 1. The extension 9 is connected to a central portion of the rear body 2 as indicated at 13 so that the extension 9 constitutes the crotch cloth member 10. As aforesaid, the fifth embodiment corresponds to the third embodiment turned inside out, so that the tapes 11 and 11′ are sewed on to the front side of the corresponding cloth members. The tapes 11 and 11′ may, of course, be sewed on to the back of the corresponding cloth members and, if preferable may be eliminated in the same manner as described by referring to the first embodiment. In the fifth embodiment, parts similar to those of the embodiments shown in FIGS. 1–4 are designated by like reference characters.

Figure 6:
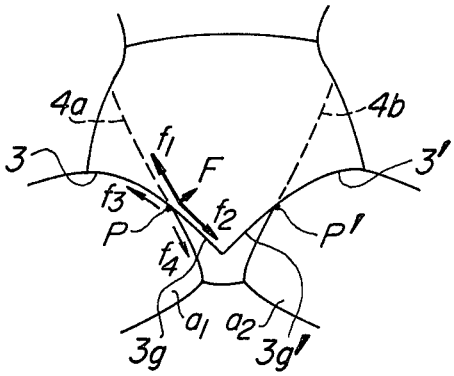
FIG. 6 is a view in explanation of forces acting on the short girdle according to a third embodiment of the invention when the wearer is in a sitting position.

FIG. 6 shows the short gridle of the third embodiment (FIG. 3) worn by a person in a sitting position. When the wearer is in a sitting position, a resultant force F of a force $f_2$ acting downwardly along the depending portion 3*g* in the central portion of the lower edge of the front body 1 and a force $f_1$ acting upwardly along the left side edge 4*a* of the abdomen keep backing cloth member 4 as shown in FIG. 6 is exerted on the point P of the leg hole 3 corresponding to the groin, so as to thereby cause the portion of the leg hole 3 corresponding to the groin to rise away from the groin. Thus the leg hole 3 is prevented from biting into the groin of the wearer, thereby eliminating unpleasant feelings which the wearer might otherwise have when in a sitting position. Likewise, the wearer does not feel uncomfortable when in a walking position (FIG. 9) in which the thin muscle bulges.

In the short girdle according to the invention, the leg hole 3 is not in closed loop form as is the case of short girdles of the prior art but the side edge of the crotch cloth member 10 contiguous with the side edge of the abdomen keep backing cloth member 4 crosses the lower edge of the front body 1 in such a manner that the side edge portion of the crotch cloth member 10 and the abdomen keep backing cloth member 4 and the lower edge of the front body 1 in crossing relation are not sewed to each other but are capable of relative movement. Thus there is substantial reserve in the leg hole 3 and it is possible to stretch same. That is, forces $f_3$ and $f_4$ tending to increase its diameter act on the leg hole 3 surrounding the thigh of the wearer, to thereby expand the point P as the thigh moves. By this action, the leg hole 3 can be stretched when the wearer sits down or raise the leg, thereby preventing the leg hole 3 biting into the groin and enabling the leg raising or sitting-down movement to be smoothly performed.

The explanation of the aforesaid action made by referring to FIG. 6 only refers to forces acting on the point P of the leg hole 3 surrounding the thigh $a_1$ of the right leg. It will be apparent that similar forces are exerted on the point P′ of the leg hole 3′ surrounding the thigh $a_2$ of the left leg. FIG. 6 shows the short girdle of the third embodiment, but it will be apparent that the first, second, fourth and fifth embodiments can also achieve the same effects as described by referring to the third embodiment shown in FIG. 6.

It is to be understood that the construction of the short girdle according to the invention can have application in bodysuits that have the same functions as the girdles.

From the foregoing description, it will be appreciated that the short girdle according to the invention provides the wearer with improved wearing comfort at all times because the stretchable leg holes enable stabilization of the lower edge of the front body to be obtained and biting of the leg holes into the groins that might otherwise occur when the wearer is in a sitting or walking position can be eliminated.

What is claimed is:

1. A short girdle formed of elasticized material comprising:

a front body formed with front leg hole portions located on opposite sides of a lower edge thereof;

a rear body formed with rear leg hole portions located on opposite sides of a lower edge thereof;

an abdomen keep cloth member sewed to one of front and rear side surfaces of the front body and extending downwardly from an upper edge of the front body toward a central portion of its lower edge in such a manner that the width thereof is successively reduced; and a crotch cloth member consecutively extending downwardly from the abdomen keep cloth member and connected at one end thereof to a central portion of the lower edge of the rear body, said crotch cloth member being formed with inner leg hole portions each located on one of opposite sides thereof;

the lower edge of the front body and side edges of the abdomen keep cloth member contiguous with side edges of the crotch cloth member crossing each other and overlapping in such a manner that they are able to move relative to each other.

2. A short girdle as claimed in claim 1, wherein said abdomen keep cloth member is sewed to said front body along the length of each of the side edges of the abdomen keep cloth member in positions displaced slightly inwardly from the latter side edges in such a manner that the distance between each seam and the corresponding side edge of the abdomen keep cloth member successively increases in going downwardly from the upper edge of said front body toward its lower edge.

3. A short girdle as claimed in claim 1, further comprising an elastic tape extending along the opposite side edges of said abdomen keep cloth member, the inner leg hole portions, the rear leg hole portions, the front leg hole portions and the central portion of the lower edge of said front body.

* * * * *